US005304959A

United States Patent [19]

Wisherd et al.

[11] Patent Number: 5,304,959

[45] Date of Patent: Apr. 19, 1994

[54] PLANAR MICROSTRIP BALUN

[75] Inventors: David S. Wisherd, Sunnyvale; Joseph M. O'Reilly, Mountain View; Brian L. Baskin, Cupertino, all of Calif.

[73] Assignee: Spectrian, Inc., Mountain View, Calif.

[21] Appl. No.: 961,995

[22] Filed: Oct. 16, 1992

[51] Int. Cl.[5] ..... H01P 5/10

[52] U.S. Cl. ..... 333/26; 333/238

[58] Field of Search ..... 333/25, 26

[56] References Cited

U.S. PATENT DOCUMENTS 5,008,639 4/1991 Pavio ..... 333/116
5,061,910 10/1991 Bouny ..... 333/26
5,157,361 10/1992 Gruchalla et al. ..... 333/238 X

FOREIGN PATENT DOCUMENTS 398419 11/1990 European Pat. Off. ..... 333/116
2084809 4/1982 United Kingdom ..... H01F 27/28

*Primary Examiner*—Paul Gensler
*Attorney, Agent, or Firm*—Townsend and Townsend Khourie and Crew

[57] ABSTRACT

A planar balun including first and second spaced parallel elongated conductors on one surface of a ceramic, plastic, polymer, synthetic fiber or a composite substrate and a third elongated conductor on a second surface of the substrate opposite from the first and second conductors. The spacing from an outer edge of each of the first and second conductors to an outer edge of the third conductor being greater than the thickness of the ceramic substrate, and the spacing between the two parallel elongated conductors being greater than $$\left(\frac{10}{\epsilon 1} + 1\right) \cdot t1, \text{ assuming } \epsilon_0 = 1.$$

The substrate is mounted on a metallic support plate which provides a ground plane spaced from the third conductor by a distance t2 in an atmosphere comprising air with the distance t2 being greater than $$\left(\frac{10}{\epsilon 1} + 1\right) \cdot t1, \text{ assuming } \epsilon_0 = 1.$$

An input of the balun is at one end of the first and second conductors and an output of the balun is at the other end of the first and second conductors. One end of the third elongated conductor on the second surface is grounded to force a balance at the two outputs.

9 Claims, 2 Drawing Sheets

PLANAR MICROSTRIP BALUN

BACKGROUND OF THE INVENTION

This invention relates generally to strip line and microstrip electronic circuits, and more particularly the invention relates to a balun for use in such circuits.

The balun is a device for matching an unbalanced coaxial transmission line with a balanced two wire system. In its simplest form, the device provides a low reflection coefficient transition between the balanced transmission line and the unbalanced line. In an unbalanced line, one of the two transmission line conductors is at ground or zero potential. A balanced line is defined as one in which the voltage to ground of the two transmission lines are equal and in opposite phase.

FIG. 1 is an illustration of a typical coaxial balun in which an unbalanced input is connected to a center conductor 10 of a coaxial transmission line with the outer conductor 12 grounded at the input. A balanced output is taken at an opposite end of the coaxial transmission line from the center conductor and the outer conductor as illustrated. While such a coaxial balun produces good results over a wide frequency bandwidth, the geometry does not lend itself well to modern surface mount technology.

Radio frequency circuits are typically embodied in hybrid circuits in which active and passive circuit components are mounted on a surface of an insulative substrate such as a ceramic substrate with the components interconnected by printed metallic conductors of copper, gold, or tantalum, for example. In the microwave range, the conductors become transmission lines. Stripline and microstrip transmission lines embody a conductor in one or more spaced ground planes.

Heretofore, discrete coaxial baluns have been mounted on a hybrid circuit substrate and interconnected with other circuit components by leads. This increases assembly cost in cutting and installing the coaxial balun.

Attempts have been made to replace coaxial baluns in hybrid circuits by using microstrip conductors. The present invention is directed to an improved microstrip balun especially suitable for surface mount technology.

SUMMARY OF THE INVENTION

The present invention provides a planar balun for use in hybrid circuits. The balun is readily fabricated using microstrip technology and can be directly mounted on a supporting substrate using surface mount technology.

Briefly, the balun comprises two spaced parallel conductors formed on one surface of a dielectric substrate with a floating conductive plate on the opposing surface of the substrate. The dielectric substrate is then mounted on a conductive carrier which provides a ground plane.

The length and spacing of the parallel conductors and the spacing of the floating plate are readily accommodated using microstrip technology.

The invention and objects and features thereof will be more readily apparent from the following detailed description and embodiment and appended claims when taken with the drawings.

DETAILED DESCRIPTION OF THE DRAWINGS

Figure 1:
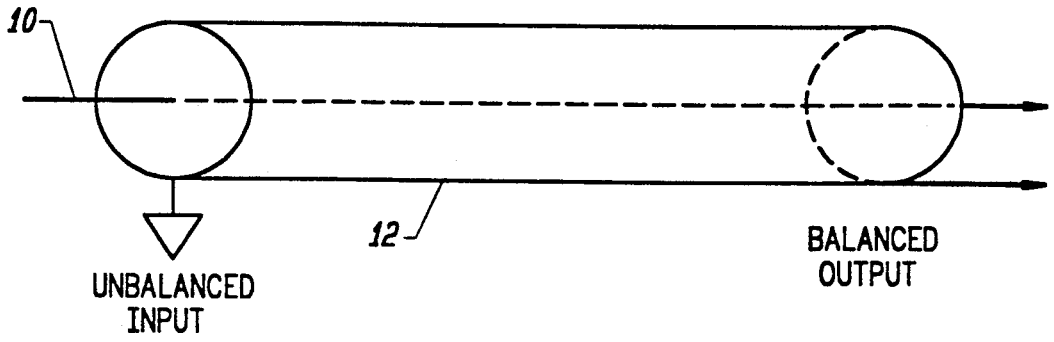
FIG. 1 (PRIOR ART)
FIG. 1 is an illustration of a prior art coaxial balun.
Figure 2:
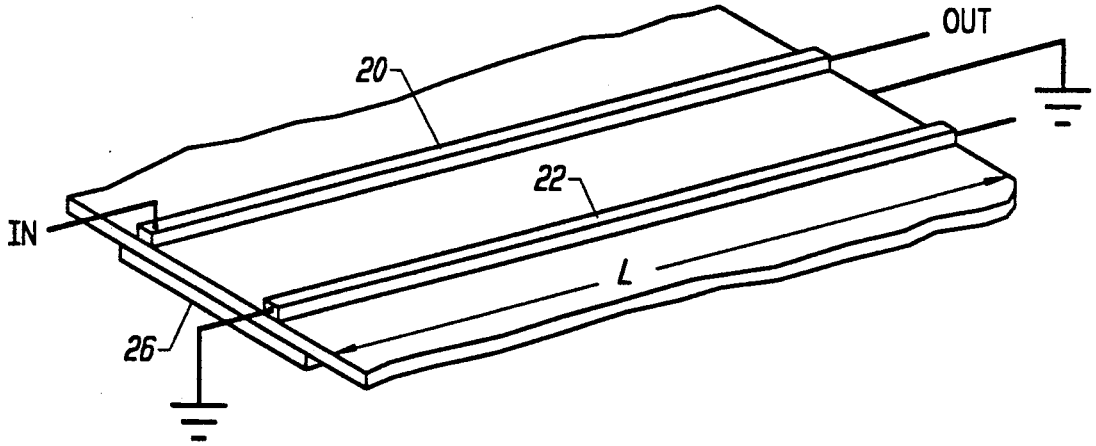
FIG. 2 is a perspective view of a microstrip balun in accordance with the present invention.

FIG. 2 is a perspective view of a microstrip balun in accordance with the present invention. The balun is readily fabricated using photoresist masking and etching techniques as typically employed in hybrid circuit fabrication.

The balun includes two spaced parallel conductors 20, 22 formed on one surface of a dielectric substrate 24 using photoresist masking and etching techniques. The conductor can be tantalum, copper, or gold or any other suitable conductive metal. The dielectric substrate 24 is typically a ceramic, plastic, polymer, synthetic fiber or a composite. The length of each conductor is equal to each other and either a quarter wave ($\lambda/4$) for match or sufficiently long for isolation inductance of the grounded (at the output) leg. A floating plate 26 is formed on an opposing surface of the dielectric substrate 24 opposite from the two parallel conductors 20, 22. Grounding of one end of the floating plate 26 at the balanced output forces the output to be balanced.

Figure 3:
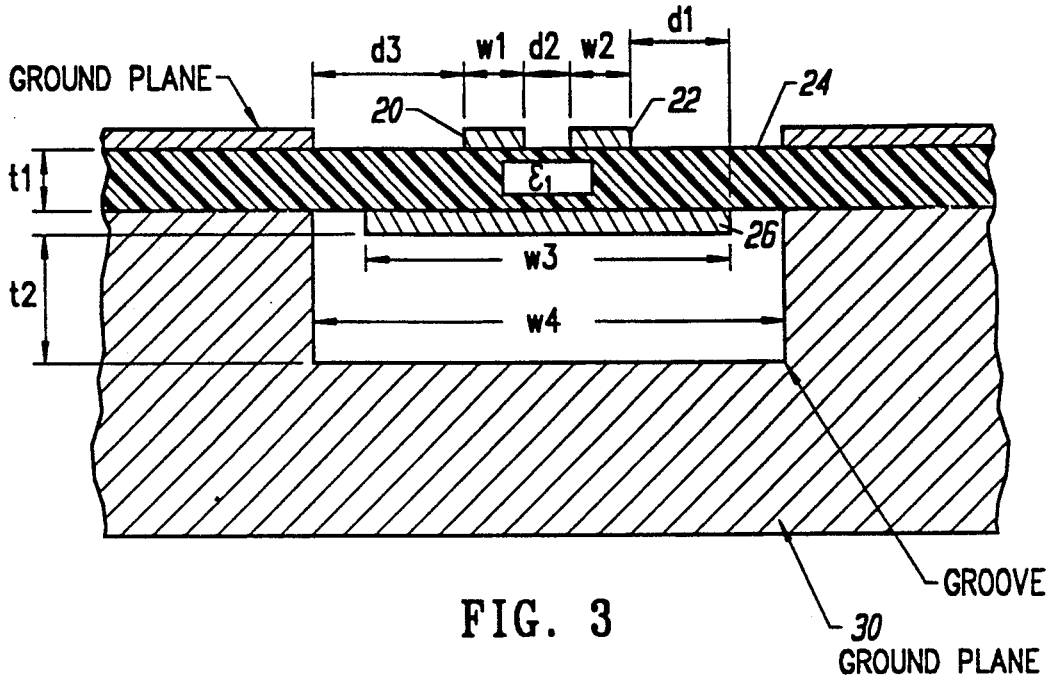
FIG. 3 is an end view of the microstrip balun of FIG. 2 illustrating dimensions thereof.

FIG. 3 is an end view of the planar balun of FIG. 2 illustrating dimensions thereof. The two parallel conductors have widths of W1 and W2 and the bottom plate has a width W3. The thickness of the dielectric substrate 24 is t1 and the spacing of substrate 24 from a bottom ground plane 30 is t2. The dielectric coefficient of the ceramic substrate 24 is designated $\epsilon_1$, and the dielectric coefficient of the space between substrate 24 and ground plane 30 (typically air) is $\epsilon_0$. $Z_{01}$ is the microstrip impedance of conductor W1 to the floating plane W3, and $Z_{02}$ is the microstrip impedance of the conductor W2 to the floating plane W3, and $Z_{01}=Z_{02}$. The balun impedance, $Z_0$, is equal to $Z_{01}$ in series with $Z_{02}$; or $Z_0$ is equal to 2 $Z_{01}$.

The spacing between the two parallel conductors W1, W2 is designated d2 and for optimum performance must be $$d2 > \left(\frac{10}{\epsilon 1} + 1\right) \cdot t1, \text{ assuming } \epsilon_0 = 1.$$

The exact value of spacing is not overly critical, however the distance d1 must be sufficiently large to minimize or eliminate parasitic coupling between two conductors. The spacing from an outer edge of conductors W1 to W2 to the outer edge of the floating bottom plate W3 is labeled d1 and must be greater than the thickness $t_1$ of the substrate 24. The spacing from an outer edge of conductors W1 and W2 to the outer edge of any ground plane coplanar with conductors W1 and W2 is labeled d3 and must be greater than 3t1 of the substrate 24. The width of the floating bottom plate W3 is not critical so long as d1 is greater than t1.

The spacing t2 is related to the thickness t1 according to the following equation:

$$t2 > \left(\frac{10}{\epsilon 1} + 1\right) \cdot t1, \text{ assuming } \epsilon_0 = 1.$$

The distance d3 must be sufficiently large to minimize electromagnetic coupling that could reduce the impedance $Z_{02}$. In like manner, each parallel conductor 20, 22 must be located sufficiently far from any ground plane. Finally, the distance between the two strips must be adequately large to minimize the electromagnetic coupling between the strips themselves.

Figure 4:
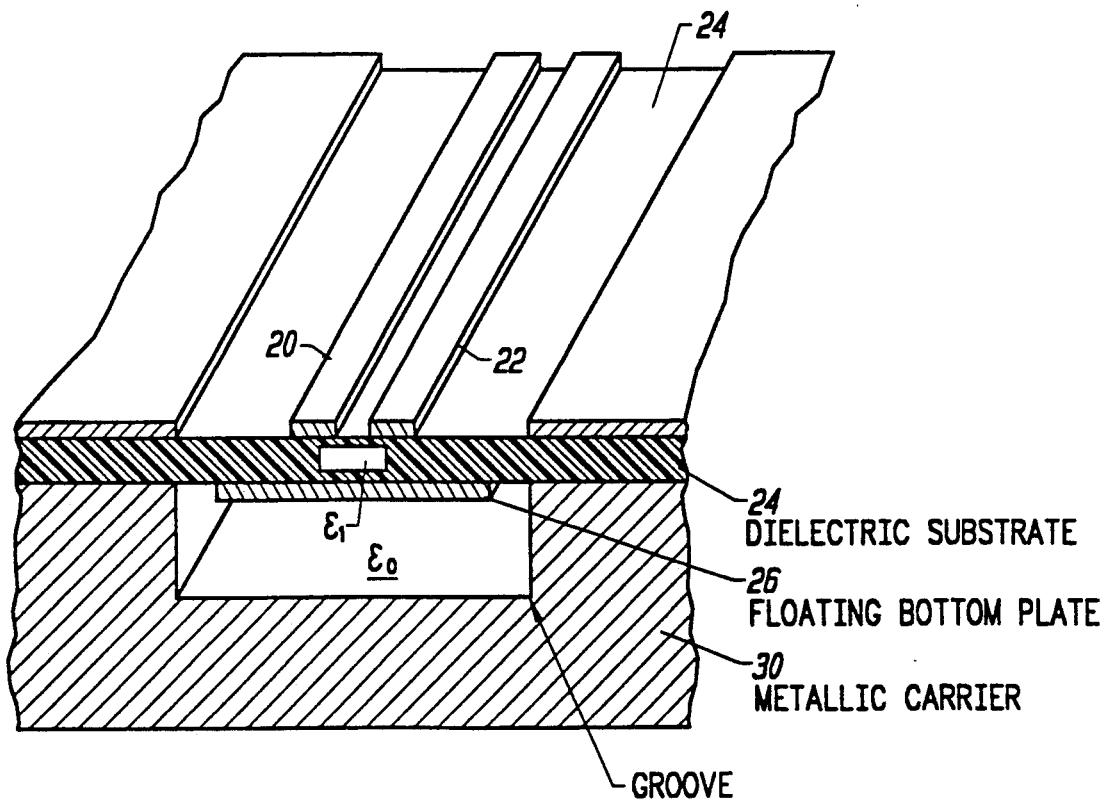
FIG. 4 is a perspective view illustrating the mounting of a microstrip balun of FIG. 2 on a conductive mounting board.

FIG. 4 is a perspective view illustrating the mounting of the substrate 24 on a metallic support plate 30 which has a groove of depth, $t_2$, formed therein for accommodating the floating bottom ground plane 26 of the balun. The depth t2 of the groove in the metallic support plate 30 is determined by the above equations. The width of the groove is labeled W4 and is defined by:

$$W4 > 2d3 + d2 + 2W1.$$

The floating bottom plate 26 is centered within this groove. It will be appreciated that ceramic substrate 24 accommodates other circuit components thereon which are coplanar with lines 20, 22.

There has been described a microstrip planar balun which is readily fabricated using photoresist masking and etching techniques as employed in microstrip fabrication and which lends itself to surface mount technology. The balun becomes an integral part of the hybrid circuit and thus requires no piece parts or fasteners.

While the invention has been described with reference to a specific embodiment, the description is illustrative of the invention and is not to be construed as limiting the invention. Various modifications and applications may occur to those skilled in the art without departing from the true spirit and scope of the invention as defined by the appended claims.

What is claimed is:

1. A planar balun comprising:

a dielectric substrate having a thickness, t1, and a dielectric coefficient, $\epsilon_r$, said substrate having first and second surfaces, a first elongated conductor and a second elongated conductor formed on said first surface in spaced parallel relationship, said conductors having a length, L, and a spacing, $d_2$, a third elongated conductor formed on said second surface opposite from said first and second conductors, the spacing from the outer edge of each of said first and second conductors to the outer edge of said third conductor being d1 with d1 being greater than t1, a balanced input at one end of said first and second conductors, an unbalanced output at another end of said first and second conductors, and a ground plane spaced from said third conductor by a distance, t2, in an atmosphere having a dielectric coefficient, $\epsilon_0$, wherein, to minimize coupling, $$t2 > \left(\frac{10}{\epsilon 1} + 1\right) \cdot t1, \text{ assuming } \epsilon_0 = 1.$$

where $\epsilon 1$ is the dielectric coefficient of said dielectric substrate.

2. The planar balun as defined by claim 1 wherein said length, L, is a quarter wave ($\lambda/4$) of input signal frequency.

3. The planar balun as defined by claim 1 wherein $$d2 > \left(\frac{10}{\epsilon 1} + 1\right).$$

4. The planar balun as defined by claim 1 wherein said dielectric substrate is selected from a ceramic, plastic, polymer, and synthetic fiber.

5. The planar balun as defined by claim 4 wherein said first, second, and third conductors are etched plated metallic layers on said substrate.

6. The planar balun as defined by claim 5 wherein said metallic layers are selected from tantalum, copper, and gold.

7. The planar balun as defined by claim 1 wherein said ground plane comprises a metallic support plate for said substrate, said plate being recessed beneath said third conductor.

8. The planar balun as defined by claim 7 wherein said atmosphere comprises a medium of air where $\epsilon 1 > \epsilon 0$.

9. The planar balun as defined by claim 8 and including a grounding connection between said third elongated conductor and ground to force a balanced output between said first elongated conductor and said second elongated conductor.

* * * * *